United States Patent [19]

Brjukhnevich et al.

[11] 4,224,511

[45] Sep. 23, 1980

[54] IMAGE INTENSIFIER

[76] Inventors: Gennady I. Brjukhnevich, prospekt Vernadskogo, 66, kv. 16; Nikolai S. Vorobiev, ulitsa Panfilova, 4/5, kv. 88; Viktor A. Miller, ulitsa Aviatsionnaya, 74, korpus 4, kv. 80; Valdis E. Postovalov, ulitsa Krasnodarskaya, 57, korpus 1, kv. 61; Mikhail Y. Schelev, ulitsa Chkalova, 12/7, kv. 17; Alexandr M. Prokhorov, ulitsa Zvenigorodskaya, 4, kv. 10; Jury N. Serdjuchenko, Yasenevo, 2 Mikroraion, korpus 3, kv. 449; Boris M. Stepanov, Leninsky prospekt, 57, kv. 34; Boris D. Smolkin, ulitsa Chkalova, 4½, kv. 80; Lidia I. Kondrashova, Profsojuznaya ulitsa, 115, kv. 39; Valentin F. Lukin, Chertanovskaya ulitsa, 21, korpus 1, kv. 50, all of Moscow, U.S.S.R.

[21] Appl. No.: 1,370

[22] Filed: Jan. 5, 1979

[51] Int. Cl.[2] ..... H01J 31/50

[52] U.S. Cl. ..... 250/213 VT; 313/99

[58] Field of Search ..... 250/213 R, 213 VT, 207; 313/373, 94, 95, 102, 99

[56] References Cited

U.S. PATENT DOCUMENTS 3,796,901 3/1974 Mayer et al. ..... 313/99

4,012,657 3/1977 Loty ..... 250/213 VT

*Primary Examiner*—David C. Nelms

*Attorney, Agent, or Firm*—Lackenbach, Lilling & Siegel

[57] ABSTRACT

An image intensifier comprises an evacuated tube envelope which accommodates a serial arrangement of a photocathode, an accelerating electrode having a hollow cylinder in which an element with a grid is disposed, said grid being placed on that end of the element which faces the photocathode, a focussing electrode made in the form of a hollow cylinder having a diameter equal to the diameter of the hollow cylinder of the accelerating electrode, an anode diaphragm, an electronic gate with a diaphragm and deflecting plates and an image scanning system each constituting a through-type two-conductor circuit and having terminals disposed on the tube envelope and a fluorescent screen, the distance L between the photocathode and the fluorescent screen, the distance $S_1$ between the accelerating and focusing electrodes, the distance $S_2$ between the focusing electrode and the anode diaphragm, as well as the lengths $l_1$, $l_2$ of the cylinders of the accelerating and focusing electrodes, respectively, being related to the diameter d of the focusing electrode as follows:

$L=(7.1 \text{ to } 8.6)d$ $S_1=(0.10 \text{ to } 0.14)d$ $S_2=(0.08 \text{ to } 0.19)d$ $l_1=(1.1 \text{ to } 1.45)d$ $l_2=(0.57 \text{ to } 0.77)d.$

5 Claims, 1 Drawing Figure

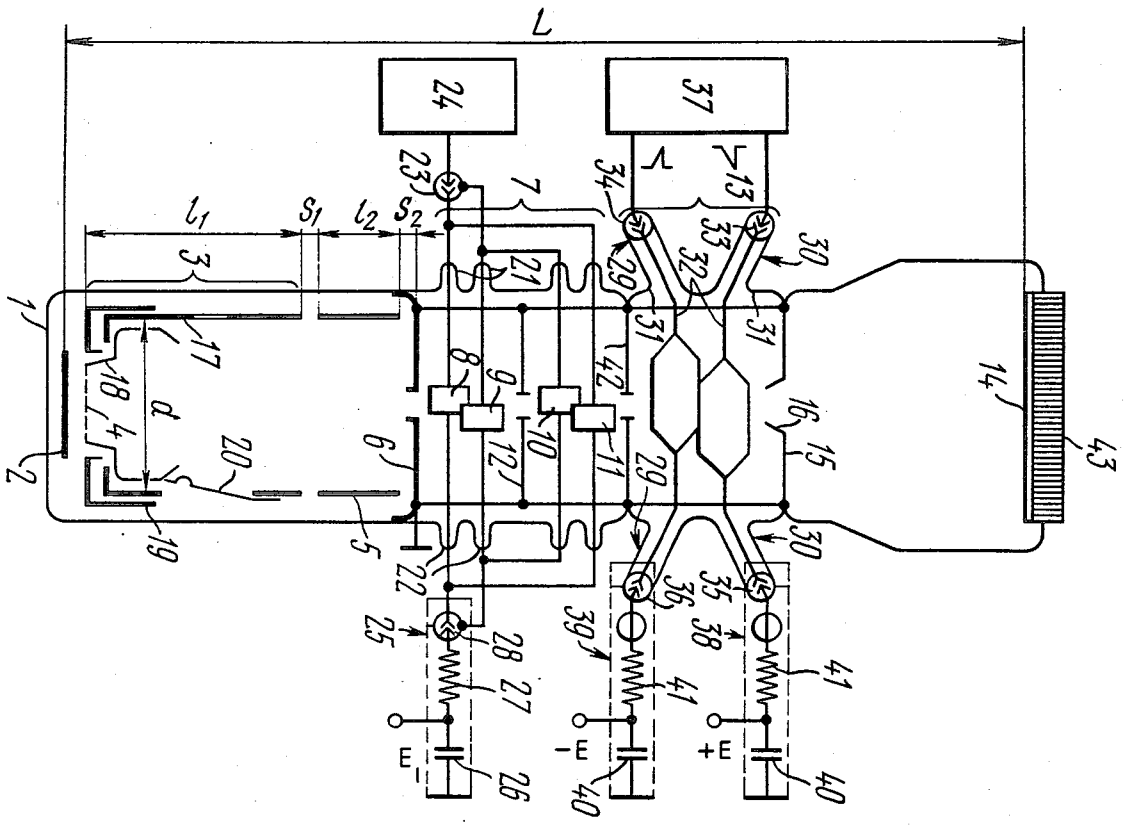
43
14
L
37
24
30
13
33
32
31
34
29
42
11
10
9
12
8
7
21
23
S2
b2
S1
b1
3
17
d
18
4
1
2
6
5
20
19
16
15
30
41
40
35
38
+E
36
41
29
39
-E
40
28
27
26
22
25
E-

IMAGE INTENSIFIER

BACKGROUND OF THE INVENTION

1. Field of the Invention

The invention relates to electronics and, more particularly, to image intensifiers designed to investigate high-speed processes in single-frame recording and photochronograph modes of operation.

The image intensifier of the invention can find use in diagnostic electrooptical apparatus applicable to experimental work in the field of physics of lasers and laser plasma, thereby permitting investigation of phenomena relating to controlled laser thermonuclear synthesis, laser photobiosynthesis, laser spectroscopy, and laser location.

2. Description of the Prior Art

Known in the art are image intensifiers comprising an evacuated tube envelope which accommodates a serial arrangement of a photocathode, a focusing electrode in the form of a truncated cone member, an anode diaphragm, an electronic gate in the form of two pairs of deflecting plates separated by a gating diaphragm, two deflection systems disposed at right angles to each other, and a fluorescent screen.

The prior art image intensifiers provide for practically inertialess control of the electron image, which is attained by virtue of an electric field produced by the control plates of the electronic gate and the deflection system.

The scene to be investigated is displayed on the screen at a higher time resolution with the result that separate phases thereof follow one after another with relatively small time intervals of the order of $10^{-11}$ s.

There exist, however, rapid and extremely rapid processes requiring picosecond time resolution. In this case, adequate image intensifiers must resolve optical signals that follow one after another with time intervals of $10^{-12}$ s and less.

In the photochronograph mode, the scattering of the transit times of the electrons required for their passage from the photocathode to a plane where they are deflected is mainly responsible for a limitation of time resolution.

On the other hand, the above-mentioned scattering depends on the scattering of the initial velocities of the electrons and a lesser magnitude of the latter provides for a better time resolution.

A reduction of the scattering of the transit times of the electrons, with other parameters of the image intensifier tube held constant, is attained by increasing the intensity of the electric field near the photocathode (cf. British Pat. No. 1,329,977, cl. H1J, 31/50).

The image intensifier as disclosed in the last-mentioned reference comprises an evacuated tube envelope which accommodates a serial arrangement of a photocathode, an accelerating electrode having a fine-mesh grid disposed near the photocathode, a focusing electrode in the form of a truncated cone member, an anode diaphragm, an electronic gate in the form of two pairs of deflecting plates separated by a gating diaphragm, an image scanning system, and a fluorescent screen.

The fine-mesh grid, having at least 300 meshes per $mm^2$ and being spaced from the photocathode by a distance of 1 to 3 mm, is maintained at a positive potential, relative to the latter, of the order of one kilovolt, thereby providing for an increase in the intensity of the electronic field near the photocathode.

However, the employment of the grid at a higher potential results in a two-fold increase of the magnification of the image intensifier. As a result, the screen luminance is decreased by a factor of 4 in the single-frame recording mode while the resolution referred to the screen is decreased by a factor of 2 in the photochronograpgh mode.

In addition, the focusing electrode, in this case, must be held at a low potential to provide for the creation of the image in the screen plane, which tends to slow down the movement of the electrons in the space between the grid and the anode diaphragm. This slow movement of the electrons results in a greater scattering of their transit times.

Another factor to be taken into consideration is the dependence of the magnification of the image intensifier on the potential at which the accelerating electrode is maintained.

Therefore, a decrease in the scattering of the transit times of the electrons, attained due to the fact that the intensity of the electric field near the photocathode is increased, is not realized to the fullest extent and does not reach a magnitude necessary for the subpicosecond range of resolution.

As an example, consider the difference $\Delta t$ between the transit times $t_o$ and t for two electrons, respectively, that move in the known image intensifier in the space between the grid and the plane of the electron beam deflection.

$$\Delta t = t_o - t \cong \sqrt{\frac{m}{2e}} \cdot \frac{2\sqrt{U_o}}{E} \cdot \left[1 + \frac{E\sqrt{U_o}}{4} \int_{Z_1}^{Z} \frac{dz}{[U(Z)]^{3/2}}\right] = \sqrt{\frac{m}{2e}} \cdot \frac{2\sqrt{U_o}}{E} \cdot \eta,$$

where $$\eta = \left[1 + \frac{E\sqrt{U_o}}{4} \int_{Z_1}^{Z_2} \frac{dz}{[U_z]^{3/2}}\right]$$

E is the intensity of the electric field near the photocathode;

$\Delta t$ is the difference between the transit times for two electrons;

m is the mass of electron;

e is the charge of the electrode;

$U_o = mV_{oz}^2/2e$ $V_{oz}$ is the normal component of the initial velocity of electron escaping from the photocathode surface;

$U_{(z)}$ is the potential distributed along axis z;

$t_o$ the transit time of the electron possessing a velocity $V_{oz}=0$;

t is the transit time of the electron possessing a velocity of $V_{oz} \neq 0$;

$z_1$ is the grid coordinate;

$z_2$ is the coordinate of the plane of the electron beam deflection.

The factor $\eta$ represents the number of times by which the difference $\Delta t$ is increased as compared with the case when the deflection plane coincides with the grid plane.

The factor $\eta$ equals 1.75 in the case of the electrooptical system of the known image intensifier. This means that the scattering of the transit times of the electrons is increased by 75 percent. That value of the factor $\eta$ is indicative of the number of times by which the time resolution is decreased because of a low potential at the focusing electrode, as compared to the calculated value of the resolution corresponding to the given intensity of the electric field near the photocathode.

The deflecting plates of the image scanning system and the electronic gate are incorporated, in the known image intensifier, in the control circuit in the form of terminating capacitive loads whose passband is limited by their resonance frequency.

In the known image intensifier, it is impossible, therefore, to obtain the speeds of image scanning which would be equal to one or two velocities of light and which would provide for adequate recording of phenomena within the picosecond and subpicosecond ranges of time resolution.

Where the scanning speed increases due to an increase in the pulse amplitude, with the result that the latter exceeds the amplitude necessary for scanning the image over the working portion of the screen, the electron beam, during deflection, impinges on the walls of the evacuated envelope of the image intensifier tube. As a result, the electrons subjected to elastic reflection from the walls cause a decrease in the image contrast and the time resolution is also decreased.

SUMMARY OF THE INVENTION

It is an object of the invention to provide, in an image intensifier, a minimal scattering of the transit times of the electrons, necessary for registration of different phenomena in the subpicosecond range of time resolution.

It is another object of the invention to provide for adequate representation of the phenomena being investigated on the screen of the image intensifier.

It is still another object of the invention to provide for a two-fold magnification of the image intensifier.

It is yet another object of the invention to make the magnification of the image intensifier independent of the potential at which the accelerating electrode is held.

There is disclosed an image intensifier comprising an evacuated tube envelope which includes a serial arrangement of a photocathode, an accelerating electrode having a grid, a focusing electrode, an anode diaphragm, an electronic gate having deflecting plates and a diaphragm, an image scanning system, and a fluorescent screen, which image intensifier comprises, according to the invention, an electronic trap electrically coupled to the anode diaphragm, the accelerating electrode comprising a hollow cylinder which accommodates an element having the grid disposed on that end of the element which faces the photocathode, the focusing electrode being a hollow cylinder having a diameter equal to the diameter of the hollow cylinder, the electronic gate and the image scanning system each constituting a through-type two-conductor circuit and having a plurality of terminals disposed on the evacuated tube envelope, selected ones of said terminals used to connect corresponding pulse generators, and respective ones of said terminals being used to connect matching circuits each having a terminating load, the electronic trap being disposed between the image scanning system and the fluorescent screen, the distance L between the photocathode and the fluorescent screen, the distance $S_1$ between the accelerating electrode and the focusing electrode, the distance $S_2$ between the focusing electrode and the anode diaphragm, and the lengths $l_1$, $l_2$ of the cylinders of the accelerating and focusing electrodes, respectively, being related to the diameter d of the focusing electrode as follows:

$L=(7.1 \text{ to } 8.6)d$ $S_4=(0.10 \text{ to } 0.14)d$ $S_2=(0.08 \text{ to } 0.19)d$ $l_1=(1.1 \text{ to } 1.45)d$ $l_2=(0.57 \text{ to } 0.77)d$ Advantageously, the accelerating electrode should have a ring member disposed on that end of its cylinder which faces the photocathode, and strings disposed on the side surface of its cylinder so that a fixed relation between the element having the grid and the ring member is provided.

Preferably, the diaphragm of the electronic gate is electrically coupled to the anode diaphragm and each of the deflecting plates of the electronic gate is an element of a respective two-conductor circuit and has two terminals on the evacuated tube envelope, one of said terminals being used to connect an electronic gate pulse generator, and a second one of said terminals being used to connect a matching circuit having a terminating load whose resistance is equal to the wave resistance of the matching circuit.

Advantageously, the image scanning system is a wideband symmetrical circuit with distributed parameters, said circuit comprising two two-conductor lines possessing identical wave resistances, outer conductors of said lines being coupled to the anode diaphragm, inner conductors of said lines constituting a deflection system, said lines having coaxial connectors at their input and output ends, the input ones of said coaxial connectors being used to connect a scan pulse generator, and the output ones of said connectors being used to connect matching circuits having terminating loads which possess resistances equal to the wave resistance of said corresponding lines. Preferably, the electronic trap comprises an element which is a truncated cone member whose larger base faces the fluorescent screen.

The image intensifier of the invention provides for a minimal scattering of the transit times of the electrons, which allows for investigation of phenomena within the subpicosecond range, and an adequate representation of these phenomena on the intensifier screen, and makes it possible to maintain the magnification at a two-fold level and make it independent of the potential applied to the accelerating electrode, with the result that the phenomena are registered at a higher time resolution.

DESCRIPTION OF THE INVENTION

The invention will now be described in more detail, by way of example, with reference to the accompanying drawing which illustrates a longitudinal section of an image intensifier, according to the invention.

The image intensifier of the invention comprises an evacuated tube envelope 1 which accommodates a serial arrangement of a photocathode 2, an accelerating electode 3 having a grid 4, a focusing electrode 5, an anode diaphragm 6, an electronic gate 7 having deflecting plates 8, 9, 10, 11 and a diaphragm 12, an image scanning system 13, and a fluorescent screen 14.

There is also provided an electronic trap 15 whose central portion constitutes an element 16 in the form of a truncated cone member. The larger base of the latter faces the fluorescent screen 14. The electron trap 15 is electrically coupled to the anode diaphragm 6 and is disposed between the image scanning system 13 and the fluorescent screen 14.

The accelerating electrode 3 comprises a hollow cylinder 17 which accommodates an element 18 having the grid 4 disposed on that end of the element 18 which faces the photocathode 2.

The accelerating electrode 3 also comprises a ring member 19 disposed on that end of the cylinder 17 which faces the photocathode 2, as well as springs 20 disposed on the side surface of the cylinder 17 to provide for fixed relation between the element 18 with the grid 4 and the ring member 19.

The focusing electrode 5 is made as a hollow cylinder which has its diameter equal to the diameter d of the hollow cylinder of the accelerating electrode 3.

The electronic gate 7 is made as a through-type two-conductor circuit and each of the deflecting plates 8, 9, 10, 11 is an element of a respective two-conductor circuit and has terminals 21, 22 on the tube envelope 1. The terminal 21 is used to connect an electronic gate pulse generator 24 via a connector 23, while the terminal 22 is used to connect a matching circuit 25. The length of the latter is chosen to provide a condition in which a double value of the time the signal takes to pass through the circuit exceeds a maximal length of the electronic gate pulses.

The terminating load of the matching circuit 25 comprises a capacitance 26 and a resistor 27 which are connected via a connector 28.

The resistance of the terminating load is equal to the wave resistance of the matching circuit 25.

The diaphragm 12 of the electronic gate 7 is disposed between the deflecting plates 8, 9 and the deflecting plates 10, 11 and is electrically coupled to the anode diaphragm 6.

The image scanning system 13 constitutes a wideband symmetrical circuit with distributed parameters, said circuit being comprised of two-conductor lines 29, 30 possessing identical wave resistances.

Outer conductors 31 of the lines 29, 30 are connected electrically to the anode diaphragm, while inner conductors 32 form a deflection system.

The lines 29, 30 are provided with coaxial connectors 33, 34 at their inputs and with coaxial connectors 35, 36 at their outputs.

The input connectors 33, 34 serve to connect a scan pulse generator 37, while the output connectors 35, 36 serve to connect matching circuits 38, 39 each having a length to provide for a condition in which a double value of the time the signal takes to pass through it exceeds a maximal length of the scan pulses.

The terminating load of each of the matching circuits 38, 39 comprises a capacitance 40 and a resistor 41.

The resistances of the terminating loads are equal to the wave resistances of their respective lines 29, 30.

A separation diaphragm 42 is disposed between the electronic gate 7 and the image scanning system 13.

There is a fiber-optic disc 43 on the outer side of the fluorescent screen 14.

The distance L between the photocathode 2 and the fluorescent screen 14, the distance $S_1$ between the accelerating electrode 3 and the focusing electrode 5, the distance $S_2$ between the focusing electrode 5 and the anode diaphragm 6, as well as the lengths $l_1$, $l_2$ of the cylinders of the accelerating and focusing electrodes 3, 5 are related to the diameter d of the focusing electrode as follows:

$L=(7.1 \text{ to } 8.6)d$
$S_1=(0.10 \text{ to } 0.14)d$
$S_2=(0.08 \text{ to } 0.19)d$
$l_1=(1.1 \text{ to } 1.45)d$
$l_2=(0.57 \text{ to } 0.77)d$ The image intensifier of the invention operates in the following manner. The radiation incident on the photocathode 2 causes it to emit photoelectrons which are accelerated by an electric field produced in the space between the photocathode 2 and the accelerating electrode 3 and are then focused on the screen 14 by an electron lens comprised of the accelerating electrode 3, focusing electrode 5 and anode diaphragm 6.

The image produced by the screen 14 is transferred on to that surface of the fiber-optic disc 43 which is exterior with respect to the image intensifier and can be registered thereon using a film or other detection means.

When no signal is presented to the photocathode 2 the image intensifier is made inoperative by applying the cutoff voltage $E_1$ to the deflecting plates 8, 9, 10, 11 of the electronic gate 7.

The image intensifier is activated by applying to the deflecting plates 8, 9, 10, 11 of the electronic gate 7 the enable voltage from the electronic gate pulse generator 24, with the result that the beam of photoelectrons is moved relative to the slit of the gating diaphragm 12.

The image appears at the screen 14 at the moment when the beam of photoelectrons passes into the slit of the gating diaphragm 12. A voltage pulse from the electronic gate pulse generator 24 passes through the deflecting plates 8, 9, 10, 11 of the electronic gate 7 and then through the r.f. matching circuit 25 to the terminating load. A reflected signal produced by the load due to non-ideal matching conditions for a wide frequency range passes through the circuit 25 to the deflecting plates 8, 9, 10, 11 during the time the voltage wave takes to travel along the circuit twice. If the electric length of the circuit 25 corresponds to a double time of signal propagation, which is greater than a maximal width of the gate voltage pulse, the reflected signal passes back to the deflecting plates 8, 9, 10, 11 after the blanking of the intensifier image so that no image distortions, which otherwise would cause time resolution loss, take place.

The image is scanned on the screen 14 using the two-conductor wide-band lines 29, 30 of the image scanning system 13 when voltage pulses from the scan pulse generator 37 are passed through the lines. The scanning speed may be equal to several magnitudes of the velocity of light, which is necessary for adequate registration of the phenomena requiring picosecond or sub-picosecond time resolution.

After leaving the lines 29, 30, the scan pulses travel along the matching circuits 38, 39 having terminating loads. Each terminating load produces a reflected signal, due to non-ideal matching condition for a wide frequency range, which signal passes through a respective matching circuit, 38 or 39, during the time which it takes to travel along the circuit twice, and is then delivered to the lines 29, 30 with the result that a sudden variation of the scanning speed occurs.

If the electric length of a respective matching circuit, 38 or 39, is so selected that the signal travels along it from the image scanning system 13 to the load and back during the time interval exceeding a maximal width of the scan pulse, then the reflected signal passes back to the system 13 after the image has been scanned and the quality of image registration is not therefore deteriorated.

After passing through the image scanning system 13, the electron beams, deflected by an angle exceeding that necessary for the scanning of the image over the entire field of the screen 14, are captured by the cone-shaped element 16 of the electronic trap 15 which is maintained at the potential of the anode diaphragm 6. As a result, the contrast of the image on the screen 14 is not reduced as it usually occurs under the action of the electrons reflected elastically from the side walls of the tube envelope 1.

The image intensifier of the invention is part of the electrooptical chambers widely used for different experimental work in physics especially concerned with cases when the phenomena to be investigated possess time and spectral characteristics which cannot be handled by the known apparatus.

As compared to the advanced competitors known in the art in this country and abroad, the image intensifier of the invention offers a higher time resolution and the information capability of the associated equipment is therefore increased.

The image intensifier of the invention can find use in photochronograph systems dealing with registration of rapid processes of picosecond and subpicosecond time resolution.

What is claimed is:

1. An image intensifier comprising:

an evacuated tube envelope;

a photocathode disposed within one end of said evacuated tube envelope;

a fluorescent screen disposed within the opposite end of said evacuated tube envelope;

an accelerating electrode disposed within said evacuated tube envelope after said photocathode;

a hollow cylinder of said accelerating electrode;

an element of said accelerating electrode, disposed within said hollow cylinder of said accelerating electrode;

a grid rigidly fixed on that end of said element of said accelerating electrode which faces said photocathode;

a focusing electrode disposed within said evacuated tube envelope after said accelerating electrode and constituting a hollow cylinder having a diameter equal to the diameter of said hollow cylinder of said accelerating electrode;

an anode diaphragm disposed after said focusing electrode;

an electronic gate disposed after said anode diaphragm, constituting a through type two-conductor circuit, and having terminals on said evacuated tube envelope, selected ones of said terminals being used to connect corresponding pulse generators, and respective ones of said terminals being used to connect matching circuits each having a terminating load;

a diaphragm of said electronic gate;

deflecting plates of said electronic gate;

an image scanning system disposed after said electronic gate, constituting a through-type two-conductor circuit, and having terminals on said evacuated tube envelope, selected ones of said terminals being used to connect corresponding pulse generators, and respective ones of said terminals being used to connect matching circuits each having a terminating load;

an electronic trap disposed within said evacuated tube envelope between said image scanning system and said fluorescent screen and electrically connected to said anode diaphragm;

the distance L between said photocathode and said fluorescent screen, the distance $S_1$ between said accelerating and focusing electrodes, the distance $S_2$ between said focusing electrode and said anode diaphragm, as well as the lengths $l_1$, $l_2$ of said cylinders of said accelerating and focusing electrodes, respectively, related to said diameter d of said focusing electrode as follows:

$L=(7.1 \text{ to } 8.6)d$ $S_1=(0.10 \text{ to } 0.14)d$ $S_2=(0.08 \text{ to } 0.19)d$ $l_1=(1.1 \text{ to } 1.45)d$ $l_2=(0.57 \text{ to } 0.77)d$

2. An image intensifier as claimed in claim 1, wherein said accelerating electrode has a ring member disposed on that end of said cylinder of said accelerating electrode which faces said photocathode; and springs of said accelerating electrode disposed on the side surface of said cylinder of said accelerating electrode so that a fixed relation between said element having said grid and said ring member is provided.

3. An image intensifier as claimed in claim 1, wherein said diaphragm of said electronic gate is electrically coupled to said anode diaphragm;

each of said deflecting plates of said electronic gate constituting an element of a respective one of said two-conductor circuits and having, on said evacuated tube envelope, two terminals, a first one of said terminals being used to connect an electronic gate pulse generator, and a second one being used to connect a matching circuit having a terminating load whose resistance is equal to the wave resistance of said matching circuit.

4. An image intensifier as claimed in claim 1, wherein said image scanning system constitutes a wide-band symmetrical circuit with distributed parameters, said circuit comprising two two-conductor lines having identical wave resistances, outer conductors of each of said two-conductor lines constituting a deflection system, an input coaxial connector of each of said two-conductor lines used to connect a scan pulse generator, an output coaxial connector of each of said two-conductor lines used to connect a corresponding matching circuit having a terminating load whose resistance is equal to the wave resistance of a respective one of said two-conductor lines.

5. An image intensifier as claimed in claim 1, wherein said electronic trap includes an element which is a truncated cone member whose larger base faces said fluorescent screen.

* * * * *